US011273659B1

(12) United States Patent
Brescia

(10) Patent No.: US 11,273,659 B1
(45) Date of Patent: Mar. 15, 2022

(54) SYSTEMS AND METHODS OF DEMARKING A LAST-READ PAGE AND LINE OF A BOUND PUBLICATION

(71) Applicant: Michael Brescia, Manlius, NY (US)

(72) Inventor: Michael Brescia, Manlius, NY (US)

( * ) Notice: Subject to any disclaimer, the term of this patent is extended or adjusted under 35 U.S.C. 154(b) by 0 days.

(21) Appl. No.: 17/102,277

(22) Filed: Nov. 23, 2020

(51) Int. Cl.
*B42D 9/00* (2006.01)

(52) U.S. Cl.
CPC ..... *B42D 9/007* (2013.01); *B42D 9/008* (2013.01)

(58) Field of Classification Search
CPC ..... B42D 9/007; B42D 9/008; B42D 9/00
USPC ..... 40/726; 281/42, 45, 46, 47
See application file for complete search history.

(56) References Cited

U.S. PATENT DOCUMENTS 4,901,665 A * 2/1990 Carlin ..... B42D 9/008 116/235
6,021,735 A * 2/2000 Kamen ..... B42D 9/001 116/234
7,441,512 B2 10/2008 Swallow et al.

OTHER PUBLICATIONS

U.S. Pat. No. 446,857 dated Feb. 24, 1891 for A.S. Fiske.
U.S. Pat. No. D. 289,423 dated Apr. 21, 1987 for Lawrence.

* cited by examiner

*Primary Examiner* — Justin V Lewis
(74) *Attorney, Agent, or Firm* — Smith Tempel Blaha LLC; Gregory Scott Smith

(57) ABSTRACT

A demarker that in one form is substantially square. On one side of the demarker, a first indicia, such as a numeral "1" is placed in one corner. A second indicia, such as a numeral "2", is placed in a diagonally opposite corner of the same side. The opposite side of the demarker does not include the first or second indicia in the corners. The demarker is then used to mark the last-read line on the last read page of a book by placing the demarker with the first and second indicia face-up on the opposite page of the last-read page. Further, for a single column books, the first indicia is aligned with the last-read line. For two-column books, the first indicia is aligned with the last-read line if the last-read line is in the first column. However, the second indicia is aligned with the last-read line if the last-read line is in the second column.

17 Claims, 11 Drawing Sheets

SYSTEMS AND METHODS OF DEMARKING A LAST-READ PAGE AND LINE OF A BOUND PUBLICATION

FIELD OF THE INVENTION

The present disclosure is in the field of reading accessories. More particularly, the present disclosure provides systems and methods of demarking a last-read line on a last-read page of a publication.

BACKGROUND

How much time have you spent looking for the spot you left off last time you closed a book? Or, how much time have you spent re-reading pages or paragraphs trying to get back to the point you left off? It happens to even the best of us, especially in this crazy busy world in which we live. You find that you have a few minutes while waiting in the carpool line, sitting in the doctor's waiting room, eating a sandwich during lunch break. You pull out that book that you have been dying to get back into and you thumb over to a dog-eared page. You crack the book open with great anticipation only to realize that you have absolutely no clue where you left off. You read the first couple sentences of the last paragraph on the right-side page and you think, "That doesn't sound familiar at all, I must have left off earlier." So you scan up the page, looking for anything familiar. Nothing. Over to the left page you go, from top to bottom now. Not ringing any bells. What the . . . You go back two pages and read a couple paragraphs, and finally see some text you remember reading. So you scan the rest of the page until you can't recall any of it. "Aha! I stopped here last time," you confirm, frustrated at how long it took. Your whole body relaxes as you melt into your seat and take a deep breath as you savor the anticipation of the moment you are about to enjoy diving back into this riveting story when the guy in the pickup truck behind you lays on his 118 decibel air horn shaking his first angrily—or—you're startled by the nurse standing at the waiting room door calling your name—or—your boss walks into the lunch room and asks if you're ready for the meeting because he has some questions for your to consider. You reach into your pocket only to discover you do not have a pen to mark your place and so you reluctantly close your book as you are violently ripped back into the chaos of the day, wondering if you will remember where you never got started next time you open the book. Or, if you are fortunate enough to have a book mark, a business card, or a napkin, you may carefully place it inside the book to mark your page but you still wonder if you will remember the line you stopped on next time you have a moment.

How many times a day does this scenario occur around the world? Just think of the millions of hours people waste searching for where to start reading. What is needed in the art is a simple, quick and reliable technique to identify the exact location that you left off in a book or magazine. A traditional bookmark is a thin marking tool, commonly made of card, leather, or fabric, used to keep track of a reader's progress in a book or magazine and allow the reader to easily return to where the previous reading session ended. Readers of books and other bound or unbound publications use bookmarks to demark a stopping point for reading.

However, using traditional bookmarks, for many readers, locating the last-read line on the demarked page may be difficult. Some readers may discontinue reading a particular book for periods comprising days or longer thus making the task of identifying the last-read line an event more difficult endeavor, such as the above-described event.

Therefore, there is a need in the art for a technique and a solution to not only demark a page, but to easily and intuitively mark the last-read line on the demarked page.

BRIEF SUMMARY

The various embodiments of the invention presented herein comprise a demarker that enables a reader to mark the last-read line on the last-read page of a media (i.e., a book, journal, magazine, etc.) as well as a method for demarking the last-read line on the last-read page of a media.

An exemplary embodiment is a system for demarking a last-read line on a last-read page in bound or even unbound material. The embodiment includes a thin flat object having a shape that includes at least two extremities (i.e., two ends of a rectangle, diagonally opposite corners of a rectangle or square, two ends of a line in a "X" shaped object, etc. A first indicia is positioned on a first side of the thin flat object at one of the at least two extremities. A second indicia visibly different from the first indicia is positioned on the first side of the thin flat object at one of the at least two extremities such that the second indicia is opposite from the first indicia.

In another embodiment, the thin flat object includes at least 4 extremities.

In another embodiment, the thin flat object is substantially square. Further, each side of the substantially square thin flat object is approximately 2.5 inches to 4.5 inches. In another configuration, each side of the substantially square thin flat object is 3.25 inches.

In yet another embodiment, the thin flat object is substantially rectangular.

In yet another embodiment, the thin flat object is substantially rectangular with the ends being tapered to a point.

In the various embodiments, the thickness of the thin flat object is approximately 14 to 24 points. In other configurations, the thickness of the thin flat object is 16 points.

In the various embodiments, the second side of the thin flat object does not include the first indicia and the second indicia positioned as on the first side, but rather may be blank or include other items (such as instructions) as long as the first indicia and the second indicia are not included as in the first side.

The present invention also includes a method for demarking a last-read line on a last-read page in bound material. The method includes obtaining a thin flat object having a shape that includes at least two extremities. A first indicia is placed on one of the at least two extremities on a first side of the thin flat object. A second indicia that is visibly different from the first indicia is placed on one of the at least two extremities such that the second indicia is opposite from the first indicia and on the first side of the thin flat object. The thin flat object is then placed between a left-side page and a right-side page of the media such that:

- if the bound material includes only one column of text and the last read line is on the upper half of the left-side page, orienting the thin flat object such that it is positioned with the first-side up and on the right-side page with the first indicia proximate to a gutter of the bound material, proximate to the last-read line and rotated such that the first indicia is in the upper left corner;
- if the bound material includes only one column of text and the last read line is on the lower half of the left-side page, orienting the thin flat object such that it is positioned with the first-side up and on the right-side page with the first indicia proximate to a gutter of the bound material, proximate to the last-read line and rotated such that the first indicia is in the lower left corner;

if the bound material includes only one column of text and the last read line is on upper half of the right-side page, orienting the thin flat object such that it is positioned with the first-side up and on the left-side page with the first indicia proximate to a gutter of the bound material, proximate to the last-read line and rotated such that the first indicia is in the upper right corner;

if the bound material includes only one column of text and the last read line is on lower half of the right-side page, orienting the thin flat object such that it is positioned with the first-side up and on the left-side page with the first indicia proximate to a gutter of the bound material, proximate to the last-read line and rotated such that the first indicia is in the lower right corner;

if the bound material includes two columns of text and the last read line is in the upper half of the first column on the left-side page, orienting the thin flat object such that it is positioned with the first-side up and on the right-side page with the first indicia proximate to a gutter of the bound material, proximate to the last-read line and rotated such that the first indicia is in the upper left corner;

if the bound material includes two columns of text and the last read line is in the lower half of the first column on the left-side page, orienting the thin flat object such that it is positioned with the first-side up and on the right-side page with the first indicia proximate to a gutter of the bound material, proximate to the last-read line and rotated such that the first indicia is in the lower left corner;

if the bound material includes two columns of text and the last read line is in the upper half of the first column on the right-side page, orienting the thin flat object such that it is positioned with the first-side up and on the left-side page with the first indicia proximate to a gutter of the bound material, proximate to the last-read line and rotated such that the first indicia is in the upper right corner;

if the bound material includes two columns of text and the last read line is in the lower half of the first column on the right-side page, orienting the thin flat object such that it is positioned with the first-side up and on the left-side page with the first indicia proximate to a gutter of the bound material, proximate to the last-read line and rotated such that the first indicia is in the lower right corner.

if the bound material includes two columns of text and the last read line is in the upper half of the second column on the left-side page, orienting the thin flat object such that it is positioned with the first-side up and on the right-side page with the second indicia proximate to a gutter of the bound material, proximate to the last-read line and rotated such that the second indicia is in the upper left corner;

if the bound material includes two columns of text and the last read line is in the lower half of the second column on the left-side page, orienting the thin flat object such that it is positioned with the first-side up and on the right-side page with the second indicia proximate to a gutter of the bound material, proximate to the last-read line and rotated such that the second indicia is in the lower left corner;

if the bound material includes two columns of text and the last read line is in the upper half of the second column on the right-side page, orienting the thin flat object such that it is positioned with the first-side up and on the left-side page with the second indicia proximate to a gutter of the bound material, proximate to the last-read line and rotated such that the second indicia is in the upper right corner; and if the bound material includes two columns of text and the last read line is in the lower half of the second column on the right-side page, orienting the thin flat object such that it is positioned with the first-side up and on the left-side page with the second indicia proximate to a gutter of the bound material, proximate to the last-read line and rotated such that the second indicia is in the lower right corner.

In some embodiments, the thin flat objection is substantially square-shaped and the two extremities are diagonally opposite corners. In such embodiments, the action of placing the first indicia on one of the at least two extremities includes placing the first indicia in the upper left corner of the thin flat object. Further the action of placing the second indicia on one of the at least two extremities includes placing the second indicia in the lower right corner. Even further, the method includes the action of ensuring that the first indicia and the second indicia are not included on a second side of the thin flat object.

In some embodiments, the action of obtaining a thin flat object further comprises obtaining a substantially square or rectangular thin flat object wherein each side of the thin flat object is 3.25 inches to 3.5 inches. In other embodiments, each side of the thin flat object is approximately 2.5 inches to 4.5 inches or more.

In other embodiments, the action of obtaining a thin flat object further comprises obtaining a thin flat object wherein the thickness of the thin flat object is approximately 14 to 18 points. In other embodiments, the thin flat object may have a thickness of 14 to 24 points or more (i.e., such as if the thin flat object is fabricated with leather or hide).

In yet other embodiments, the action of obtaining a thin flat object further comprises obtaining a thin flat object wherein the thickness of the thin flat object is 16 points.

These and other embodiments are described in further detail in connection with the below-listed figures, the description accompanying the figures and the claims.

DETAILED DESCRIPTION OF THE VARIOUS EMBODIMENTS

Figure 1A:
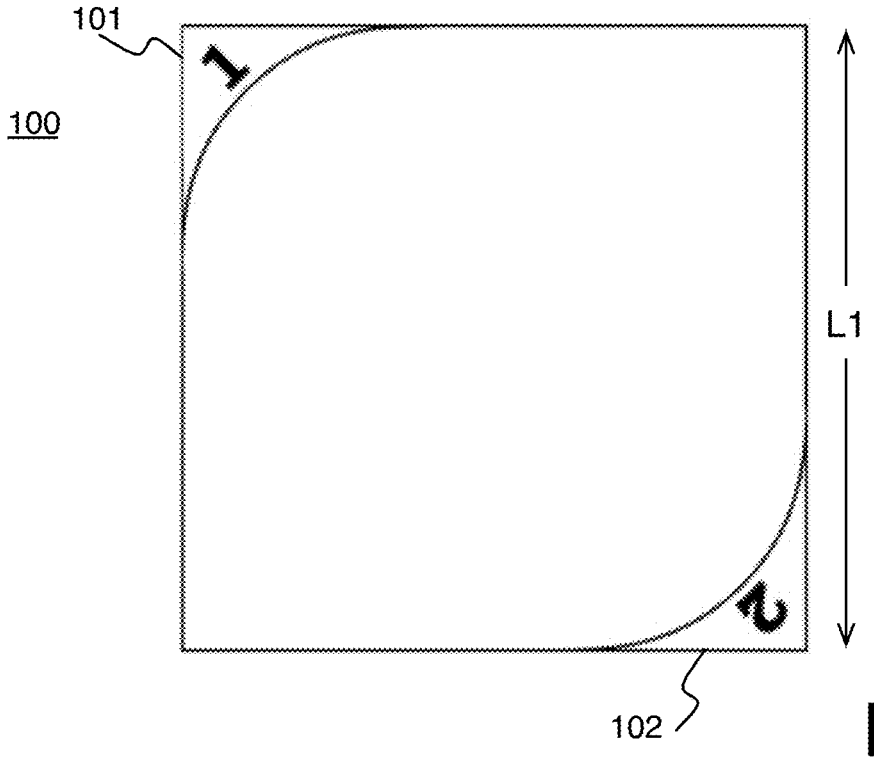
FIG. 1A depicts an exemplary embodiment of the demarker.

The present invention, as well as features and aspects thereof, is directed towards providing a bookmark for identifying the last page and last-read line of a book, periodical, magazine, etc., and a method for marking the last-read line of the same.

In general, the various embodiments of the bookmark advantageously allow a user to easily and readily mark the last-line, or the next-line to read or the stopping point of a book, periodical, magazine, etc. (collectively referred to as "a book"). The various embodiments are referred to herein as "the demarker", being short for demarcation, which is defined as a dividing line or the action of fixing the boundary or limits of something. In essence, the demarker identifies the boundary line of where a reader stopped reading and where the reader can commence at the next opportunity.

The various embodiments of the apparatus, systems and methods described herein provide for a bookmark that includes two simple indicia, such as the numeral "1" and the numeral "2" imprinted in or proximate to opposite corners or diagonal extremes of one side of the demarker. The numerals "1" and "2" are used to point to and identify the last-read line on a last-read page of a single or double column per page book or other bound publication, respectively.

The various embodiments of the demarker can take on many sizes and shapes. In an exemplary embodiment, the demarker may be square or rectangular in shape with dimension of about 2.5 to 4.5 or more inches per side, or in other embodiments, 3.25 to 3.50 inches per side. The demarker may be made of any of a variety of materials at a variety of thicknesses. In an exemplary embodiment, the demarker is constructed out of a 16-point cardstock. In various embodiments, the demarker is thin, flexible, and flat and is intended for bound publications such as books, pamphlets and thick magazines that typically use bookmarks, but may also be utilized for non-bound media. However, it should be appreciated that embodiments may also be rigid or semi-rigid as well.

In exemplary embodiments, the demarker may be physically configured to be thick enough for the user to locate his/her last page quickly without searching through the pages of the subject book. The thickness and texture of various embodiments of the demarker are such that the bookmark remains conveniently lodged in the gutter area of the subject book but is easily located and removed and does not physically compromise the gutter or binding of the book.

When a book is in single column per page format, the bookmark is placed with the corner marked with the first indicia (i.e., the numeral "1") facing inward toward the gutter. The corner marked "1" is placed at the last-read line whether the line is on the left hand or right-hand page.

When a book is in two columns per page format and the last-read line is in the second or right hand column of the left hand page or the right hand page, the bookmark is similarly placed with the corner marked with the second indicia (i.e., the numeral "2") facing inward toward the book's gutter. The corner is placed at the last-read line of the second or right-hand column whether the line is on the left-hand page or the right-hand page.

Turning now to the figures in which various embodiments are illustrated as non-limiting examples, the various embodiments, functions, operations, benefits and aspects of the demarker are more fully described.

FIG. 1A depicts an exemplary embodiment of the demarker. In the embodiment illustrated in FIG. 1A, the demarker 100 is shown as being a square shape with each of the sides of the square being of a length L1. The top left corner of the demarker 100 includes a first indicia 101 and the opposing corner, or bottom right corner of the demarker 100 includes a second indicia 102. In the illustrated embodiment, the first indicia 101 is illustrated as the numeral "1" and the second indicia 102 is illustrated as the numeral "2". The first indicia 101 and the second indicia 102 are imprinted, affixed to, or otherwise positioned in opposite corners of the same side of the bookmark.

Figure 1B:
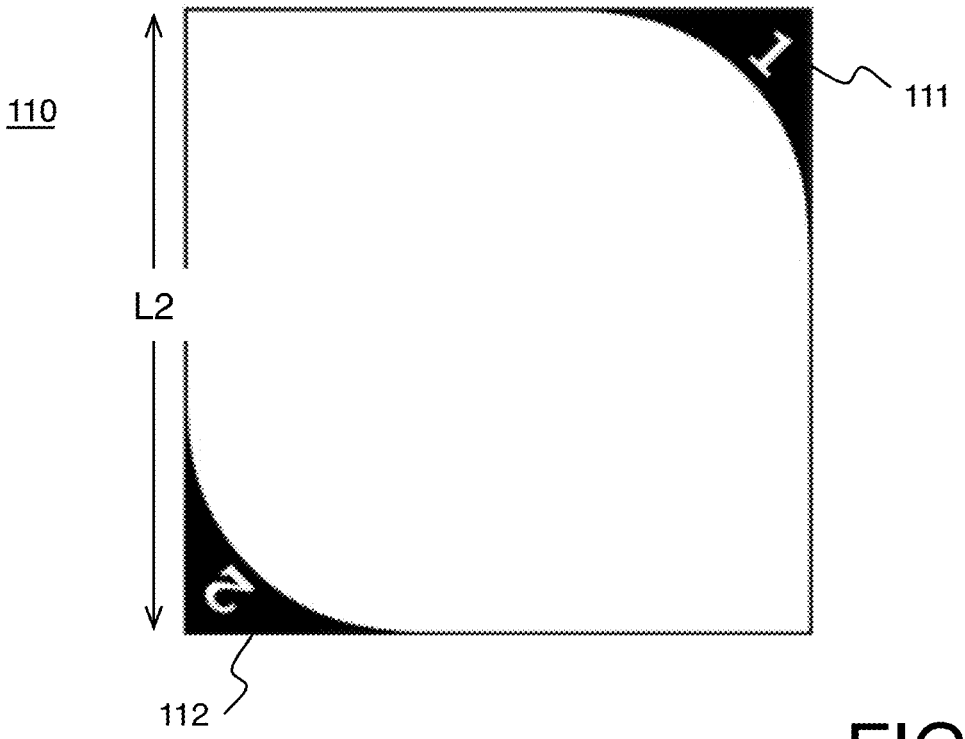
FIG. 1B depicts another exemplary embodiment of the demarker.

FIG. 1B depicts another exemplary embodiment of the demarker. The embodiment of FIG. 1B is similar to the embodiment of FIG. 1A with the exception that the demarker 110 is in essence, rotated clock-wise ninety degrees. The second embodiment of the demarker 110 is provided to illustrate that the various embodiments of the demarker can be differently configured as long as the first indicia and second indicia are located on opposing corners. As such, the demarker 110 includes a first indicia 111 in the upper right hand corner of the demarker 110 and a second indicia 112 in the lower left hand corner of the demarker 110. Similarly, in the illustrated embodiment, the first indicia 111 is illustrated as the numeral "1" with a dark background and light lettering, and the second indicia 112 is illustrated as the numeral "2" with a dark background and light lettering. The first indicia 111 and the second indicia 112 are imprinted, affixed to, or otherwise positioned in opposite corners of the same side of the bookmark.

Figure 1C:
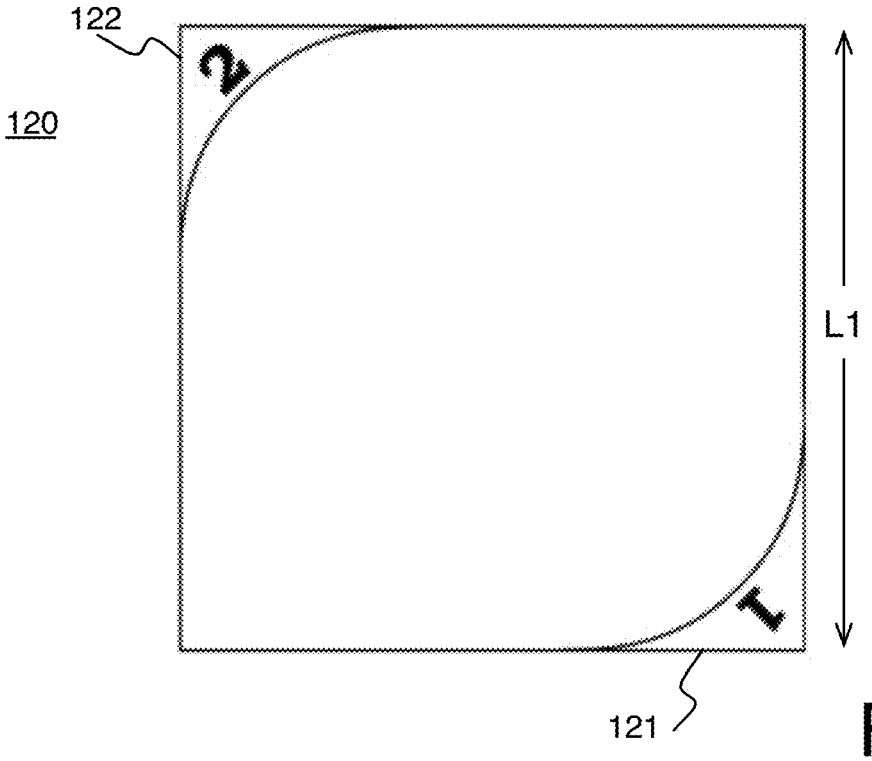
FIG. 1C depicts yet another exemplary embodiment of the demarker.

FIG. 1C depicts yet another exemplary embodiment of the demarker. The embodiment of FIG. 1C is similar to the embodiments of FIGS. 1A and 1B with the exception that the demarker 120 is in essence, rotated ninety degrees counter-clockwise relative to the embodiment in FIG. 1A and ninety degrees clockwise relative to the embodiment in FIG. 1B. The third embodiment of the demarker 120 is provided to illustrate that the various embodiments of the demarker can be differently configured as long as the first indicia and second indicia are located on opposing corners. As such, the demarker 120 includes a first indicia 121 in the lower right hand corner of the demarker 120 and a second indicia 122 in the upper left hand corner of the demarker 120. Similarly, in the illustrated embodiment, the first indicia 121 is illustrated as the numeral "1" and the second indicia 122 is illustrated as the numeral "2". The first indicia 121 and the second indicia 122 are imprinted, affixed or otherwise positioned in opposite corners of the same side of the bookmark.

Figure 1D:
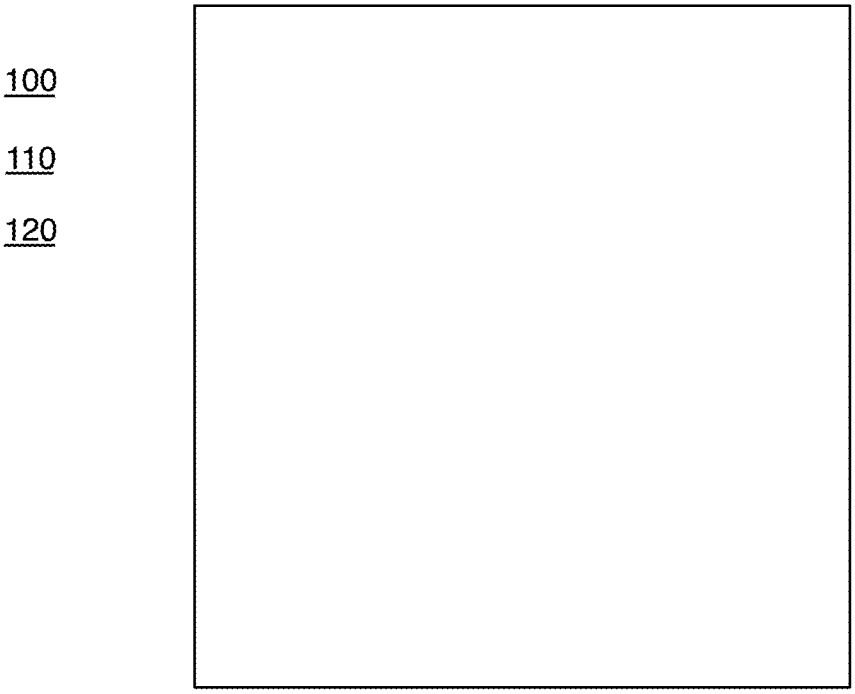
FIG. 1D depicts the back side of any of the embodiments illustrated in FIG. 1A, FIG. 1B or FIG. 1C.

FIG. 1D depicts the back side of any of the embodiments illustrated in FIG. 1A, FIG. 1B or FIG. 1C. As such, the illustrated demarker may be demarker 100, 110 and/or 120. In the illustrated embodiment, the back-side of the demarker 110, 110 and 120 is illustrated as being completely blank. In other embodiments the back-side of the demarker 110, 110 and 120 may include a design or instructions on how to use the demarker 110, 110 and 120. In other embodiments, the first side with the first and second indicia may have a green background while the back-side of the demarker may be red (where green indicates "go" or the operable side of the demarker as opposed to red indicating the non-functional side. However, what is important is that the backside of the demarker 110, 110 and 120 is clearly distinguished from the front-side. This is important because the demarker 110, 110 and 120 can be utilized to identify the last-read line on either the left-side page of a book or the right-side page of the book, as will be described in further detail below. As such, the orientation of the front-side and back-side of the demarker 110, 110 and 120 is instrumental in identifying the last-read line.

The operation of the embodiments illustrated in FIG. 1A, FIG. 1B and FIG. 1C (collectively referred to as FIG. 1) is illustrated in figures FIG. 2A, FIG. 2B, FIG. 2C and FIG. 2D (collectively referred to herein as FIG. 2). FIG. 2 is a guide for using embodiments of the demarkers 110, 110 and 120 as presented in FIG. 1 and as provided herein with respect to books or pages within a book that only include one column of text (i.e., books that have only one column of text on either of the pages displayed or within the book). It should be appreciated that some books may include a single column of text on some pages and two columns of text on other pages. The various embodiments of the demarker advantageously work in any environment or combination of pages that include single or double columns.

In general, the first indicia illustrated in the various embodiments is utilized to mark the last-read location for uses in which the book or page only includes one column of text on the left and/or right side pages. Because there is only one column of text on each page, or a particular page, the first indicia indicates that the demarker is being used to identify a text location in the first column. For books, or pages that include two columns of text, the first indicia is still used to identify a text location in the first column and the second indicia is utilized to identify a text location in the second column. The demarker is utilized to identify which column of text the last-read line is in by using the first indicia for the first column and the second indicia for the second column. As such, if the first indicia is positioned in the gutter, it is indicative that the last-read line is in the first column. Likewise, if the second indicia is positioned in the gutter, it is indicative that the last-read line is in the second column. In addition, as previously mentioned, the orientation of the front-side and back-side of the demarker is used to identify which page (left-side page or right-side page) includes the last-read line of text. For instance, if the demarker is oriented with the front-side up when positioned on a left-side page, it is indicative that the last-read line is on the right-side page. If the demarker is oriented with the front-side up when positioned on a right-side page, it is indicative that the last-read line is on the left-side page. Or stated otherwise, when the book is opened to the location of the demarker, and the demarker is front-side up, whatever side of the book it resides on, the last-read line is on the other side of the book.

The operation of the embodiments illustrated in FIG. 1A, FIG. 1B and FIG. 1C (collectively referred to as FIG. 1) are illustrated in figures FIG. 2A, FIG. 2B, FIG. 2C and FIG. 2D (collectively referred to herein as FIG. 2). FIG. 2 is a guide for using embodiments of the demarker as presented in FIG. 1 and as provided herein with publications that include only one column, whereas FIG. 3A, FIG. 3B, FIG. 3C and FIG. 3D (collectively referred to as FIG. 3) is a guide for using embodiments of the demarker as presented in FIG. 1 for publications with two columns.

Figure 2A:
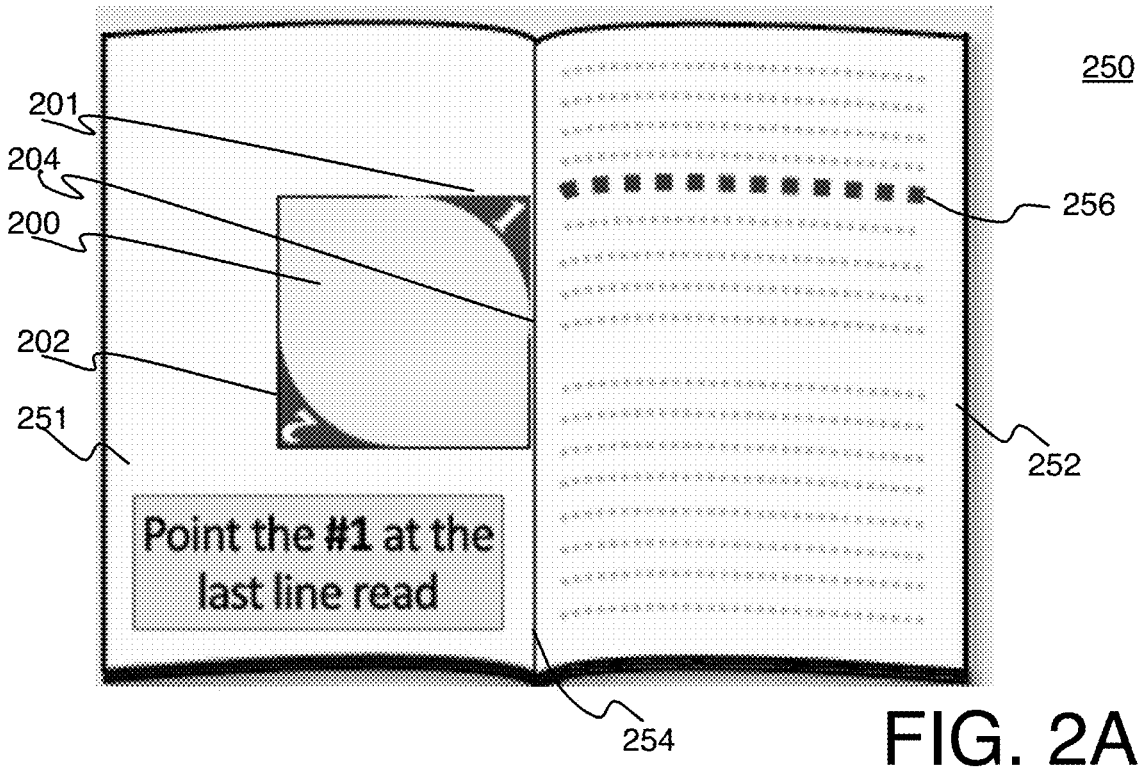
FIG. 2A depicts a publication 250 in the form of a bound book or magazine with left-side pages 251 and right-side pages 252.

FIG. 2A depicts a publication 250 in the form of a bound book or magazine with left-side pages 251 and right-side pages 252. In the illustrated embodiment, the last-line read 256 is located on the upper portion of the right-side page 252, which is illustrated as including a single column of text. It should be understood that throughout this description, the embodiments refer to marking the "last line read" however, it should be appreciated that the demarker may be utilized to mark the last line read or the next line to read depending on user preference. Further, the demarker may also be used to mark the last paragraph read or the next paragraph to read just as well. The demarker 200 is shown as being placed face up on the top of the left-side page 251. Further, the demarker 200 is oriented such that the first indicia 201 is located on the upper right corner of the demarker 200 and the lower right corner of the demarker 200 is blank, or does not include an indicia. The corner of the demarker 200 with the first indicia 201 is oriented in this fashion by rotating the demarker 200 until the first indicia 201 is in the upper right corner. The edge 204 of the demarker 200 that exist from the corner containing the first indicia 201 and the corner below the first indicia 201 is nestled into or sits in the gutter 254 of the spine and points toward a particular line of text 256 (i.e., the text at the location where the user stopped reading and/or should start reading during the next session). Thus, in the illustrated embodiment, wherein the first indicia 201 includes the numeral "1", once the user reopens the book to the page containing the demarker 200, the user observes that the demarker 200 indicates that the last line read is on the right-side page 252, is in the first column of text and the corner of the demarker 200 containing the first indicia 201 is pointing to the last line read 256. If the back-side of the demarker is facing up on the right-side page 252, the user simply flips it over like turning a page so that the front-side is facing up and sitting on the left-side page 251.

Figure 2B:
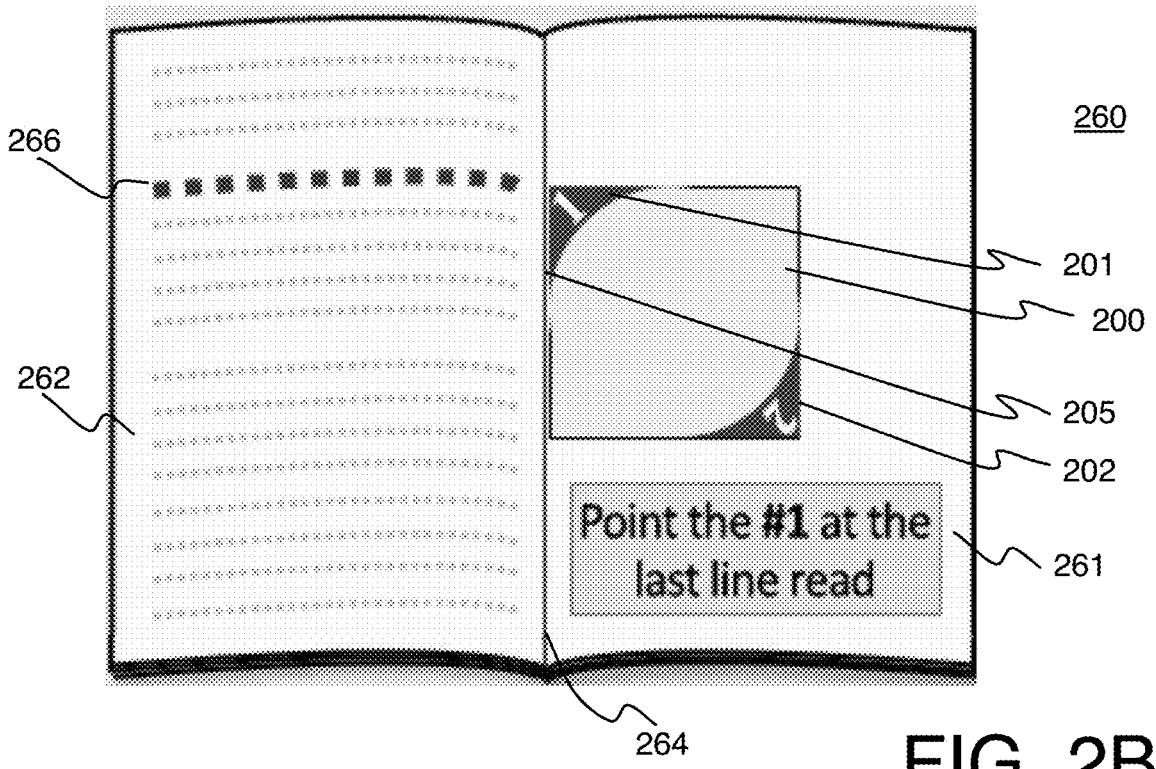
FIG. 2B depicts a publication 260 in the form of a bound book or magazine with left-side pages 261 and right-side pages 262.

FIG. 2B depicts a publication 260 in the form of a bound book or magazine with right-side pages 261 and left-side pages 262. In the illustrated embodiment, the last-line read 266 is located on the upper portion of the left-side page 262, which is illustrated as including a single column of text. The demarker 200 is shown as being placed face up on the top of the right-side page 261. Further, the demarker 200 is oriented such that the first indicia 201 is located on the upper left corner of the demarker 200 and the lower left corner of the demarker 200 is blank, or does not include an indicia. The second indicia 202 is thus oriented to be at the lower right-hand corner of the demarker 200. The corner of the demarker 200 with the first indicia 201 is oriented in this fashion by rotating the demarker 200 until the first indicia 201 is in the upper left corner. The edge 205 of the demarker 200 that exist from the corner containing the first indicia 201 and the corner below the first indicia 201 is nestled into or sits in the gutter 264 of the spine and points toward a particular line of text 266 (i.e., the text at the location where the user stopped reading and/or should start reading during the next session). Thus, in the illustrated embodiment, wherein the first indicia 201 includes the numeral "1", once the user reopens the book to the page containing the demarker 200, the user observes that the demarker 200 indicates that the last line read 266 is on the left-side page 262, is in the first column of text and the corner of the demarker 200 containing the first indicia 201 is pointing to the last line read. If the back-side of the demarker 200 is facing up on the left-side page 262, the user simply flips it over like turning a page so that the front-side is facing up and sitting on the right-side page 261.

Figure 2C:
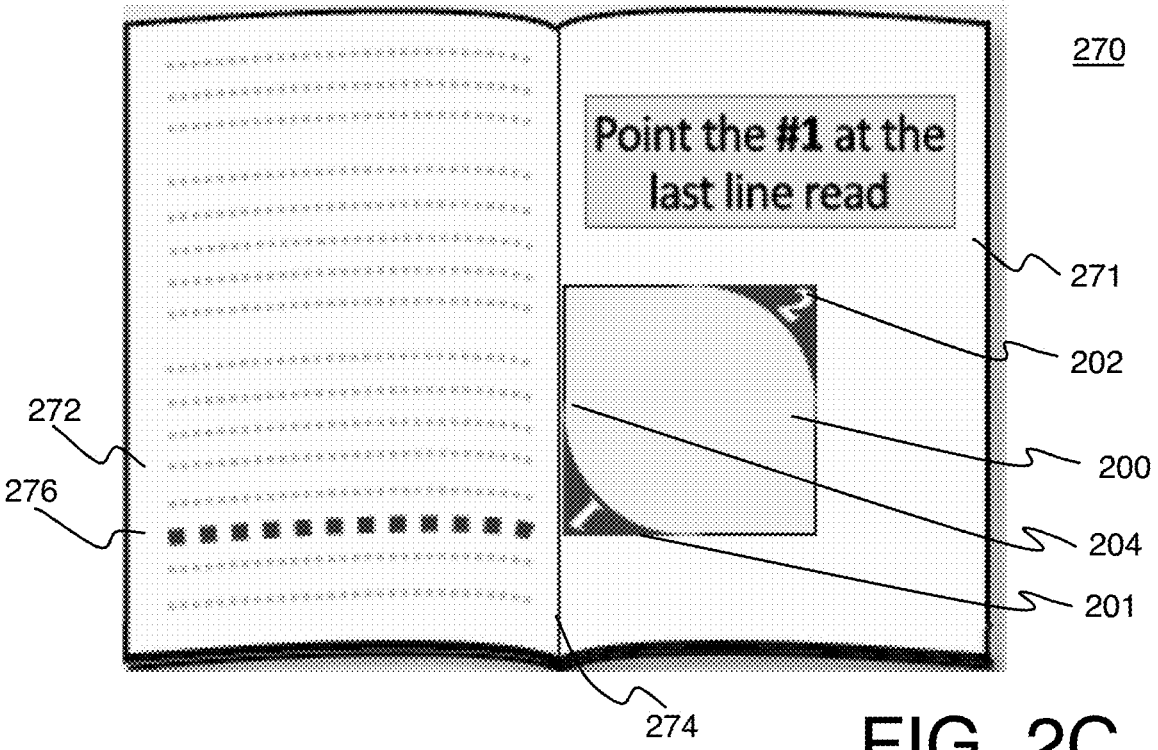
FIG. 2C depicts a publication 270 in the form of a bound book or magazine with left-side pages 272 and right-side pages 271.

FIG. 2C depicts a publication 270 in the form of a bound book or magazine with left-side pages 272 and right-side pages 271. In the illustrated embodiment, the last-line read 276 is located on the lower portion of the left-side page 272, which is illustrated as including a single column of text. The demarker 200 is shown as being placed face up on the top of the right-side page 271. Further, the demarker 200 is oriented such that the first indicia 201 is located on the lower left corner of the demarker 200 and the upper left corner of the demarker 200 is blank, or does not include an indicia. The second indicia 202 is thus oriented to be at the upper right-hand corner of the demarker 200. The corner of the demarker 200 with the first indicia 201 is oriented in this fashion by rotating the demarker 200 until the first indicia 201 is in the lower left corner. The edge 204 of the demarker 200 that exist from the corner containing the first indicia 201 and the corner above the first indicia 201 is nestled into or sits in the gutter 274 of the spine and points toward a particular line of text 276 (i.e., the text at the location where the user stopped reading and/or should start reading during the next session). Thus, in the illustrated embodiment, wherein the first indicia 201 includes the numeral "1", once the user reopens the book to the page containing the demarker 200, the user observes that the demarker 200 indicates that the last line read 276 is on the left-side page 272, is in the first column of text and the corner of the demarker 200 containing the first indicia 201 is pointing to the last line read. If the back-side of the demarker 200 is facing up on the left-side page 272, the user simply flips it over like turning a page so that the front-side is facing up and sitting on the right-side page 271.

Figure 2D:
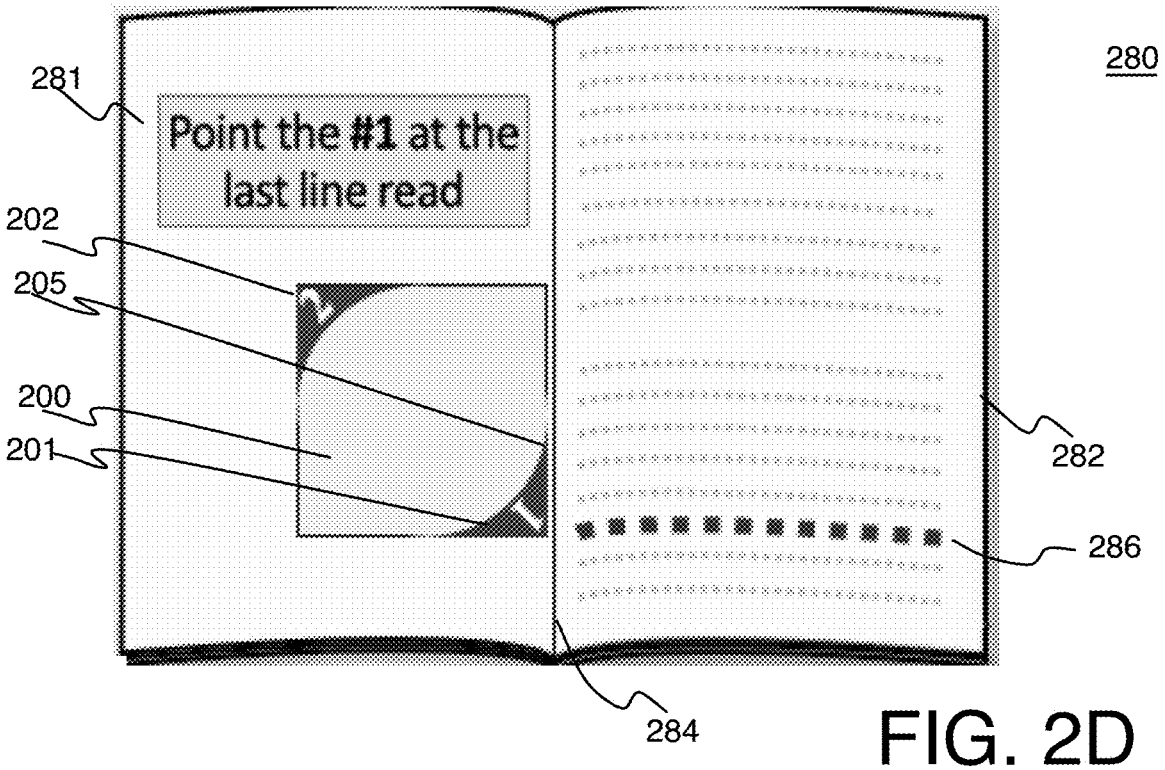
FIG. 2D depicts a publication 280 in the form of a bound book or magazine with left-side pages 281 and right-side pages 282.

FIG. 2D depicts a publication 280 in the form of a bound book or magazine with left-side pages 281 and right-side pages 282. In the illustrated embodiment, the last-line read 286 is located on the lower portion of the right-side page 282, which is illustrated as including a single column of text. The demarker 200 is shown as being placed face up on the lower portion of the left-side page 281. Further, the demarker 200 is oriented such that the first indicia 201 is located on the lower right corner of the demarker 200 and the upper right corner of the demarker 200 is blank, or does not include an indicia. The corner of the demarker 200 that includes the second indicia 202 is thus oriented to be in the upper left corner. The corner of the demarker 200 with the first indicia 201 is oriented in this fashion by rotating the demarker 200 until the first indicia 201 is in the lower right corner. The edge 205 of the demarker 200 that exist from the corner containing the first indicia 201 and the corner above the first indicia 201 is nestled into or sits in the gutter 284 of the spine and points toward a particular line of text 286 (i.e., the text at the location where the user stopped reading and/or should start reading during the next session). Thus, in the illustrated embodiment, wherein the first indicia 201 includes the numeral "1", once the user reopens the book to the page containing the demarker 200, the user observes that the demarker 200 indicates that the last line read 286 is on the right-side page 282, is in the first column of text and the corner of the demarker 200 containing the first indicia 201 is pointing to the last line read. If the back-side of the demarker is facing up on the right-side page 282, the user simply flips it over like turning a page so that the front-side is facing up and sitting on the left-side page 281.

Turning now to publications with two columns per page, the operation of the various embodiments of the demarker are described.

Figure 3A:
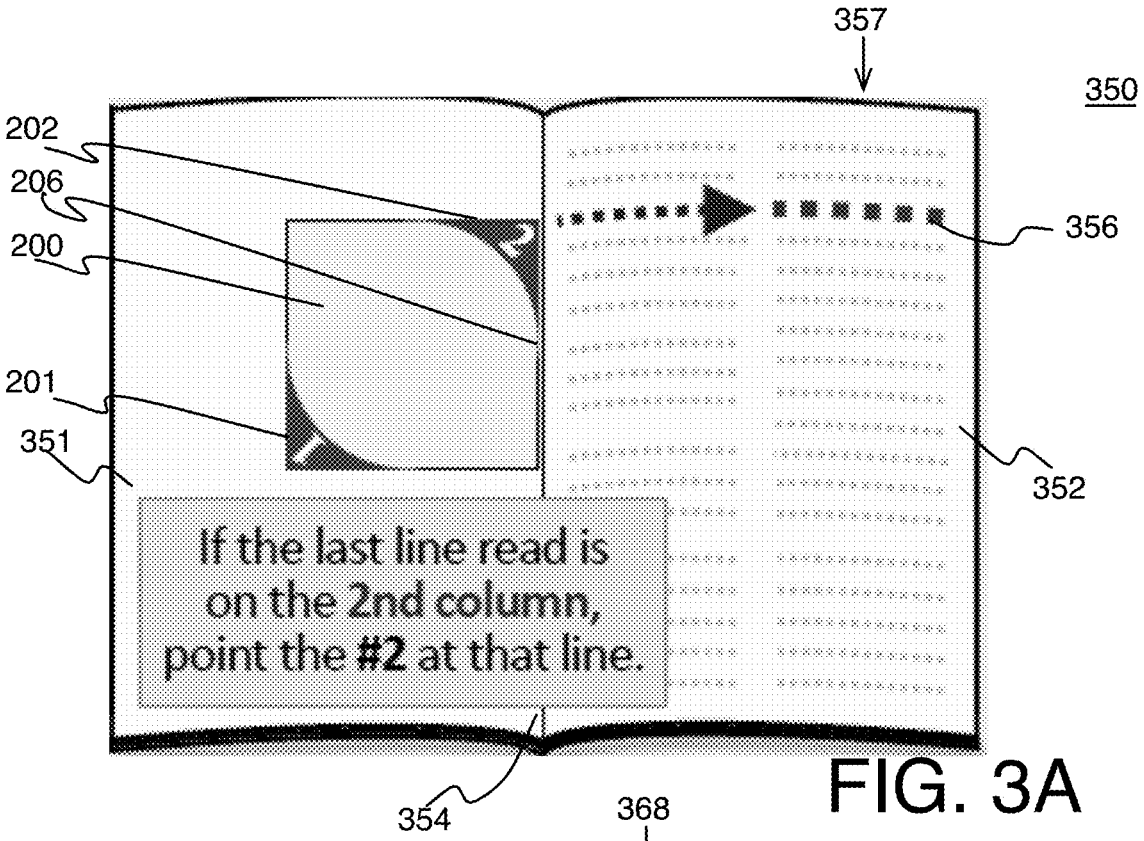
FIG. 3A depicts a publication 350 in the form of a bound book or magazine with left-side pages 351 and right-side pages 352.

FIG. 3A depicts a publication 350 in the form of a bound book or magazine with left-side pages 351 and right-side pages 352. In the illustrated embodiment, the last-line read 356 is located in the second column 357 on the upper portion of the right-side page 352, which is illustrated as including two columns of text. The demarker 200 is shown as being placed face up on the upper portion of the left-side page 351. Further, the demarker 200 is oriented such that the second indicia 202 is located on the upper right corner of the demarker 200 and the lower right corner of the demarker 200 is blank, or does not include an indicia. Thus, the first indicia 201 is oriented to be at the lower left corner of the demarker 200. The corner of the demarker 200 with the second indicia 202 is oriented in this fashion by rotating the demarker 200 until the second indicia 202 is in the upper right corner. The edge 206 of the demarker 200 that exist from the corner containing the second indicia 202 and the corner below the second indicia 202 is nestled into or sits in the gutter 354 of the spine and points toward a particular line of text 356 (i.e., the text at the location where the user stopped reading and/or should start reading during the next session). Thus, in the illustrated embodiment, wherein the second indicia 202 includes the numeral "2", once the user reopens the book to the page containing the demarker 200, the user observes that the demarker 200 indicates that the last line read 356 is on the right-side page 352, is in the second column of text 357 and the corner of the demarker 200 containing the second indicia 202 is pointing to the last line read 356. If the back-side of the demarker is facing up on the right-side page 352, the user simply flips it over like turning a page so that the front-side is facing up and sitting on the left-side page 351.

Figure 3B:
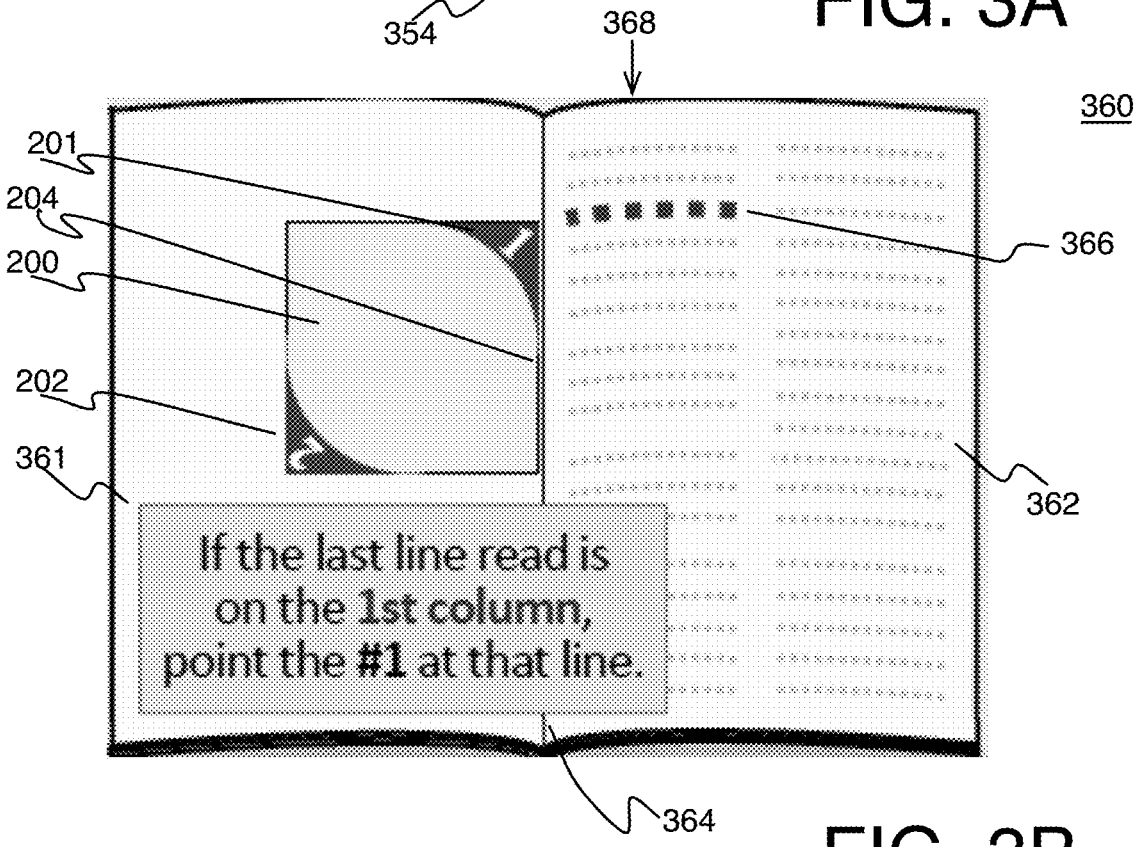
FIG. 3B depicts a publication 360 in the form of a bound book or magazine with left-side pages 361 and right-side pages 362.

FIG. 3B depicts a publication 360 in the form of a bound book or magazine with left-side pages 361 and right-side pages 362. In the illustrated embodiment, the last-line read 366 is located in the first column 368 on the upper portion of the right-side page 362, which is illustrated as including two columns of text. The demarker 200 is shown as being placed face up on the upper portion of the left-side page 361. Further, the demarker 200 is oriented such that the first indicia 201 is located on the upper right corner of the demarker 200 and the lower right corner of the demarker 200 is blank, or does not include an indicia. The second indicia 202 is thus oriented to be at the lower left-hand corner of the demarker 200. The corner of the demarker 200 with the first indicia 201 is oriented in this fashion by rotating the demarker 200 until the first indicia 201 is in the upper right corner. The edge 204 of the demarker 200 that exist from the corner containing the first indicia 201 and the corner below the first indicia 201 is nestled into or sits in the gutter 364 of the spine and points toward a particular line of text 366 (i.e., the text at the location where the user stopped reading and/or should start reading during the next session). Thus, in the illustrated embodiment, wherein the first indicia 201 includes the numeral "1", once the user reopens the book to the page containing the demarker 200, the user observes that the demarker 200 indicates that the last line read 366 is on the right-side page 362, is in the first column of text 368 and the corner of the demarker 200 containing the first indicia 201 is pointing to the last line read 366. If the back-side of the demarker 200 is facing up on the left-side page 362, the user simply flips it over like turning a page so that the front-side is facing up and sitting on the right-side page 361.

Figure 3C:
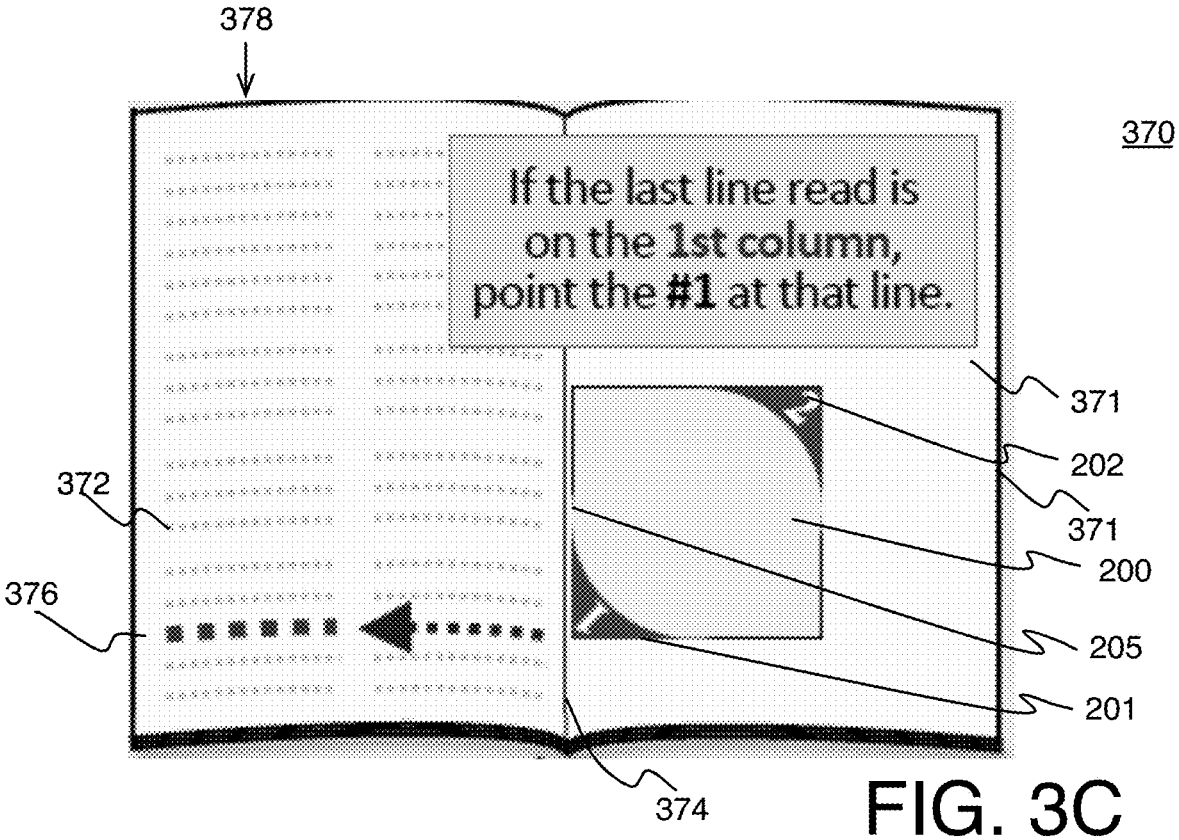
FIG. 3C depicts a publication 370 in the form of a bound book or magazine with left-side pages 372 and right-side pages 371.

FIG. 3C depicts a publication 370 in the form of a bound book or magazine with left-side pages 372 and right-side pages 371. In the illustrated embodiment, the last-line read 376 is located in the first column 378 on the lower portion of the left-side page 372, which is illustrated as including two columns of text. The demarker 200 is shown as being placed face up on the upper portion of the right-side page 371. Further, the demarker 200 is oriented such that the first indicia 201 is located on the lower left corner of the demarker 200 and the upper left corner of the demarker 200 is blank, or does not include an indicia. The second indicia 202 is thus oriented to be at the upper right-hand corner of the demarker 200. The corner of the demarker 200 with the first indicia 201 is oriented in this fashion by rotating the demarker 200 until the first indicia 201 is in the lower left corner. The edge 205 of the demarker 200 that exist from the corner containing the first indicia 201 and the corner above the first indicia 201 is nestled into or sits in the gutter 374 of the spine and points toward a particular line of text 376 (i.e., the text at the location where the user stopped reading and/or should start reading during the next session). Thus, in the illustrated embodiment, wherein the first indicia 201 includes the numeral "1", once the user reopens the book to the page containing the demarker 200, the user observes that the demarker 200 indicates that the last line read 376 is on the left-side page 372, is in the first column of text 378 and the corner of the demarker 200 containing the first indicia 201 is pointing to the last line read 376. If the back-side of the demarker 200 is facing up on the left-side page 372, the user simply flips it over like turning a page so that the front-side is facing up and sitting on the right-side page 371.

Figure 3D:
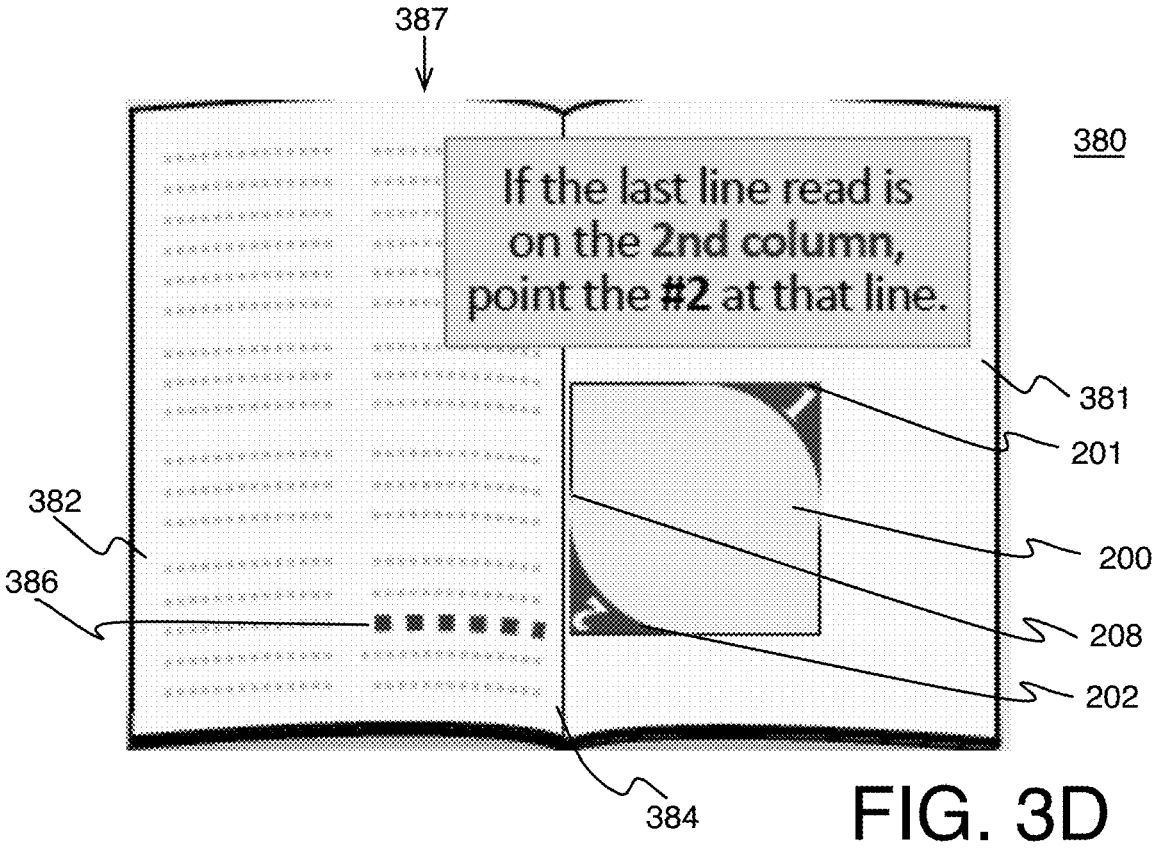
FIG. 3D depicts a publication 380 in the form of a bound book or magazine with left-side pages 382 and right-side pages 381.

FIG. 3D depicts a publication 380 in the form of a bound book or magazine with left-side pages 382 and right-side pages 381. In the illustrated embodiment, the last-line read 386 is located in the second column 387 on the lower portion of the left-side page 382, which is illustrated as including two columns of text. The demarker 200 is shown as being placed face up on the lower portion of the right-side page 381. Further, the demarker 200 is oriented such that the second indicia 202 is located on the lower left corner of the demarker 200 and the upper left corner of the demarker 200 is blank, or does not include an indicia. The corner of the demarker 200 that includes the first indicia 201 is thus oriented to be in the upper right corner. The corner of the demarker 200 with the second indicia 202 is oriented in this fashion by rotating the demarker 200 until the second indicia 202 is in the lower left corner. The edge 208 of the demarker 200 that exist from the corner containing the second indicia 202 and the corner above the second indicia 202 is nestled into or sits in the gutter 384 of the spine and points toward a particular line of text 386 (i.e., the text at the location where the user stopped reading and/or should start reading during the next session). Thus, in the illustrated embodiment, wherein the second indicia 202 includes the numeral "2", once the user reopens the book to the page containing the demarker 200, the user observes that the demarker 200 indicates that the last line read 386 is on the left-side page 382, is in the second column of text 387 and the corner of the demarker 200 containing the second indicia 202 is pointing to the last line read 386. If the back-side of the demarker is facing up on the left-side page 382, the user simply flips it over like turning a page so that the front-side is facing up and sitting on the right-side page 381.

It should be appreciated that in the various embodiments described, the indicia can be any of a variety of elements, such as numerals "1" and "2" as described, letters "A" or "B", phrases such as "Column 1" and "Column 2", etc. Further, the simplicity of the markings on the various embodiments of the demarkers, and the use of the corners of the demarker as pointers, it is not necessary to include any further indicia such as arrows to provide guidance to the user. The presence of the first indicia in the gutter of the book is all that is required to indicate the page, column and location of the last line read. Further, the presence of the second indicia in the gutter of the book is all that is required to indicate the page, column and location of the last line read. Orienting the demarker in different fashions based on the last line read being in the upper portion or lower portion of the page is a matter of preference. The user can certainly rotate the demarker such that the first indicia is on the upper side of the demarker even if the last line read is in the lower portion of the page, and similarly with the second indicia. The only effect this may have is that the demarker may hang out of the edge of the book, which may be a preference for some users as it may assist in locating the correct page in the book. Thus, it is clear that the elegance of the present invention is that utilizing only two distinguishable indicia in opposing corners or extremities of the demarker is sufficient to identify the exact location of the last line read. The user simply has to put the correct indicia corresponding with the correct column number into the gutter of the book such that the front side of the demarker is facing upwards on the opposite side of the book from the location of the last line read, and point the indicia at the last line read. As such, it is not even necessary that the user fully rotate the demarker such that a full edge fits within the gutter. The user can simply ensure that the corner including the correct indicia is residing in the gutter of the book. Advantageously, the various embodiments only require that the two different indicia located at opposing extremities of the demarker (i.e. diagonal corners of a square or rectangle, or opposing ends of an elongated shape).

In the embodiments illustrated in FIGS. 1-3, the demarker has been presented as being square. However, it should be appreciated that other shapes may also be employed for various embodiments, as is described in connection with other embodiments illustrated in FIG. 4, FIG. 5 and FIG. 6. For the embodiments illustrated in FIGS. 1-3, the dimensions of the demarker may be 2.5 inches to 4.5 inches or more per side, while in other embodiments, the demarker may be approximately 3.25 inches to 3.50 inches per side. In some embodiments, the size of the demarker may be selected based on the size of the book. Thus, for a small paperback, the demarker may be approximately 3.25 inches per side or less. For a library sized hard bound book, the demarker may be approximately 3.25 inches per side or greater. For large coffee table sized books, the demarker may be 4-5 inches per side or more.

Depending on how the user uses the demarker, the demarker may be fully encased within the pages of a book rather than hanging out of the top, bottom or side of the pages. As such, the user must identify the location of the demarker before finding the last line read. To assist in this process, the demarker may be substantially thicker than the thickness of a page in the book. Advantageously, this assists the user in finding the location of the demarker.

The pages in a book can vary greatly from book to book. Typically, the pages of a book are approximately 0.12 mm (0.005 inches) which is approximately 4.8 points. The thickness of the pages may be less for thick books and may be more for small books like paperbacks. For instance, the pages of a novel may be approximately 90 GSM (4.8 pts), the pages of a glossy magazine approximately 120 GSM (6.15 pts) and the cover of a paperback book approximately 205 GSM (8.8 pts). To ensure that the demarker is suitable for most applications, the weight or thickness of the demarker should be selected to be substantially thicker than most typical applications. As such, in exemplary embodiments, the thickness of the demarker may range from 10 pts to 24 pts, or more typically 16 pts.

Various embodiments of the demarker may be constructed from any of a wide variety of materials such as paper, cardboard, metal, plastic, glass, laminated paper, cloth, leather or wood as a few non-limiting examples.

Figure 4:
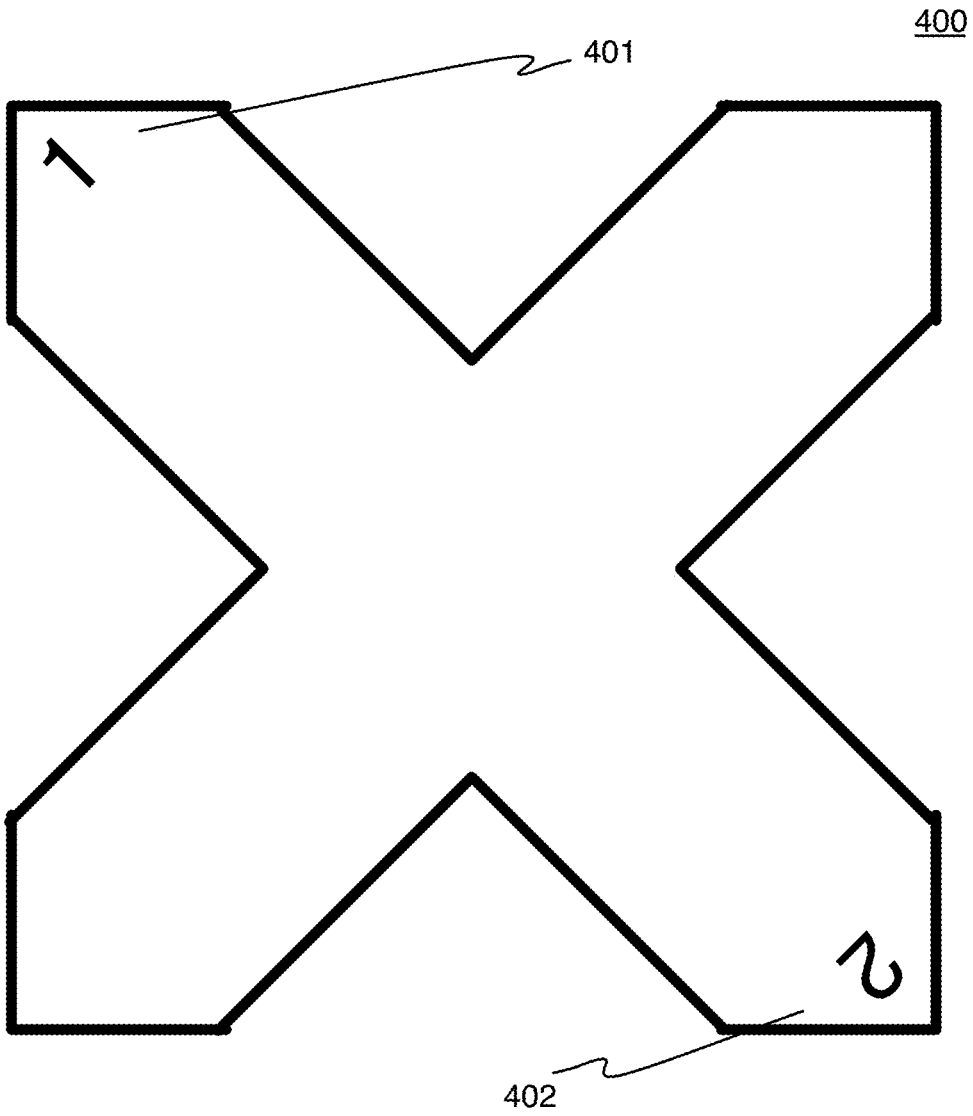
FIG. 4 is an alternative design or a demarker that utilizes the last page read technique of the previously described embodiments.

FIG. 4 is an alternative design or a demarker that utilizes the last page read technique of the previously described embodiments. In the illustrated embodiment, the shape of the demarker 400 is an "X" with the extremities of the "X" being tapered to a point. The first indicia 401 is located on one extremity of one line of the "X" while the second indicia 402 is located on the other extremity of the same line of the "X", or the indicia are located at opposing ends of one line of the "X". The "X" embodiment of the demarker can be used in the same manner as illustrated in FIG. 2 and FIG. 3.

Figure 5:
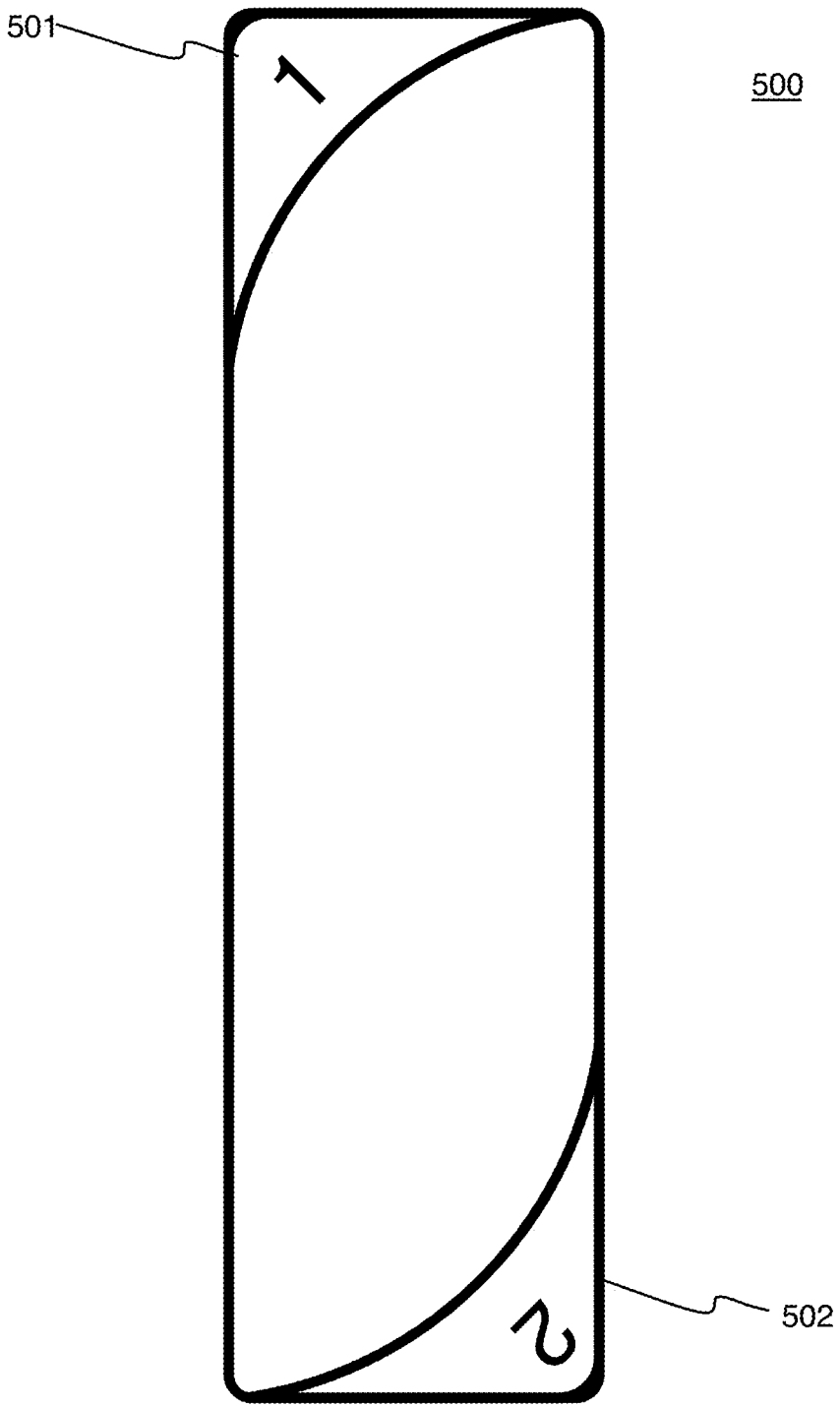
FIG. 5 is yet another design for a demarker that utilizes a more standard bookmark shape (i.e. elongated rectangle).

FIG. 5 is yet another design for a demarker that utilizes a more standard bookmark shape (i.e. elongated rectangle). In the illustrated embodiment, the demarker 500 is an elongated rectangle with the first indicia 501 being located in the upper left hand corner and the second indicia 502 being located in the lower right hand corner. Similar to the embodiments in FIG. 1, the orientation of the indicia may vary as long as they are in opposing corners of the demarker. The exemplary embodiment of the demarker illustrated in FIG. 5 can be used in the same manner as illustrated in FIG. 2 and FIG. 3. As such, the demarker 500 may be placed at the location of the last read line by having the elongated edge of the demarker 500 placed parallel to the gutter or, the elongated edge of the demarker 500 may be orthogonal or 90 degrees relative to the gutter.

Figure 6:
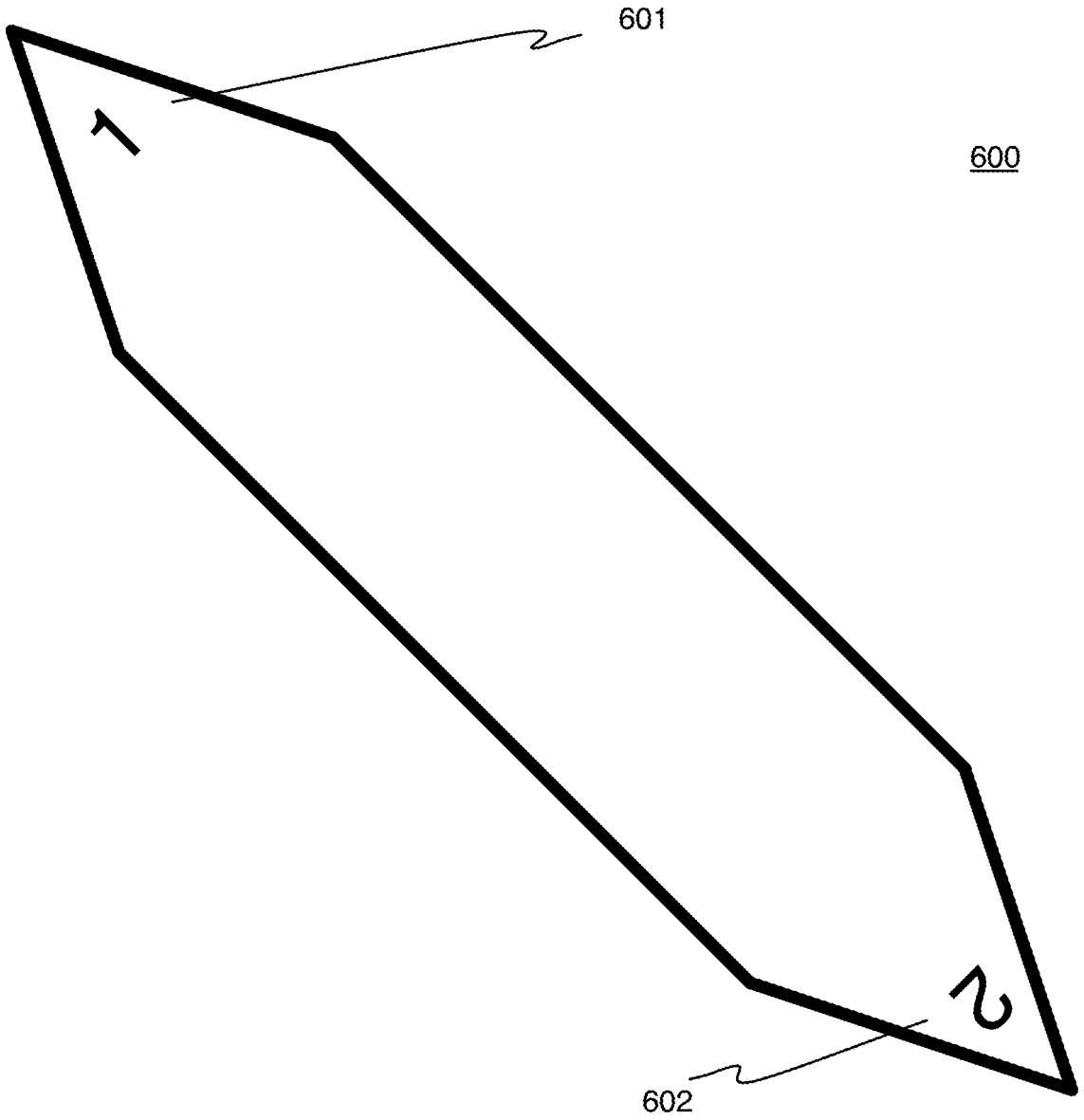
FIG. 6 is yet another design for a demarker that utilizes an elongated rectangle with tapered ends.

FIG. 6 is yet another design for a demarker that utilizes an elongated rectangle with tapered ends. In the illustrated embodiment, the demarker 600 is an elongated rectangle with tapered ends. The first indicia 601 is positioned at one end of the demarker 600 proximate to the point of the taper and the second indicia 602 is positioned at the opposite end from the first indicia 601 proximate to the point of the taper. The exemplary embodiment of the demarker illustrated in FIG. 6 can be used in the same manner as illustrated in FIG. 2 and FIG. 3 or it may be utilized such that the demarker 600 is always orthogonal or 90 degrees relative to the gutter. As such, the demarker 600 may be placed at the location of the last read line by having an edge of the taper being placed parallel to the gutter or, the elongated edge of the demarker 600 may be orthogonal or 90 degrees relative to the gutter.

Figure 7:
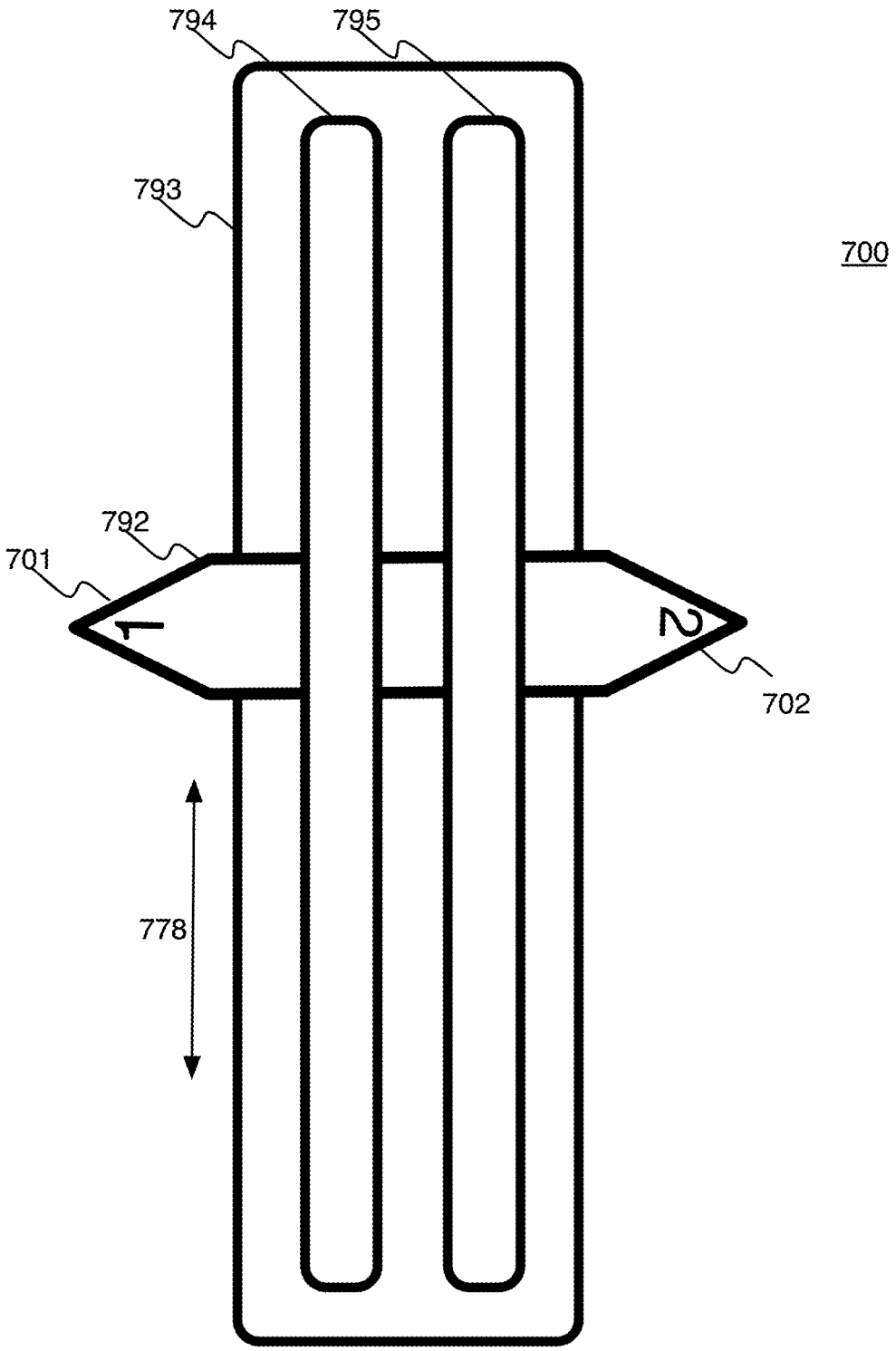
FIG. 7 is yet another design for a demarker that utilizes the demarking aspect of the various embodiments.

FIG. 7 is yet another design for a demarker that utilizes the demarking aspect of the various embodiments. In the illustrated embodiment, the demarker 700 includes an first elongated portion 792 with a first indicia 701 located at one end of the first elongated portion 792 and a second indicia 702 located at the opposite end of the first elongated portion 792. The first elongated portion 792 is mounted on a second elongated portion 793 in such a fashion that the first elongated portion 792 can be slid up and down the second elongated portion 793 either partially or the full length of the second elongated portion 793 as illustrated by arrow 778. The first elongated portion 792 can be mounted to the second elongated portion 793 in a variety of manners as long as the first elongated portion 792 can be moved to different positions along the length of the second elongated portion 793. For instance, in some embodiments, the first elongated portion may be attached to the second elongated portion 793 using VELCOR. Thus, the first elongated portion 792 can be moved to any position along the second elongated portion 793. In the illustrated embodiment, slits 794 and 795 are cut in the second elongated portion 793 and the firsts elongated portion 792 is weaved between the slits. Similar to the other embodiments, the back side of the demarker 700 does not include the first and second indicia and so, the demarker 700 can operate similar to the other embodiments by rotating the demarker 180 degrees or, removing the first elongated portion 792, rotating it 180 degrees and reinserting it into the second elongated portion 793. Advantageously, this embodiment may allow for the top and/or bottom of the second elongated portion to protrude from between the pages of the book making it easier to locate the last read page. As such, the thickness of this embodiment may be thinner without compromising the ability to located the last read page.

Figure 8:
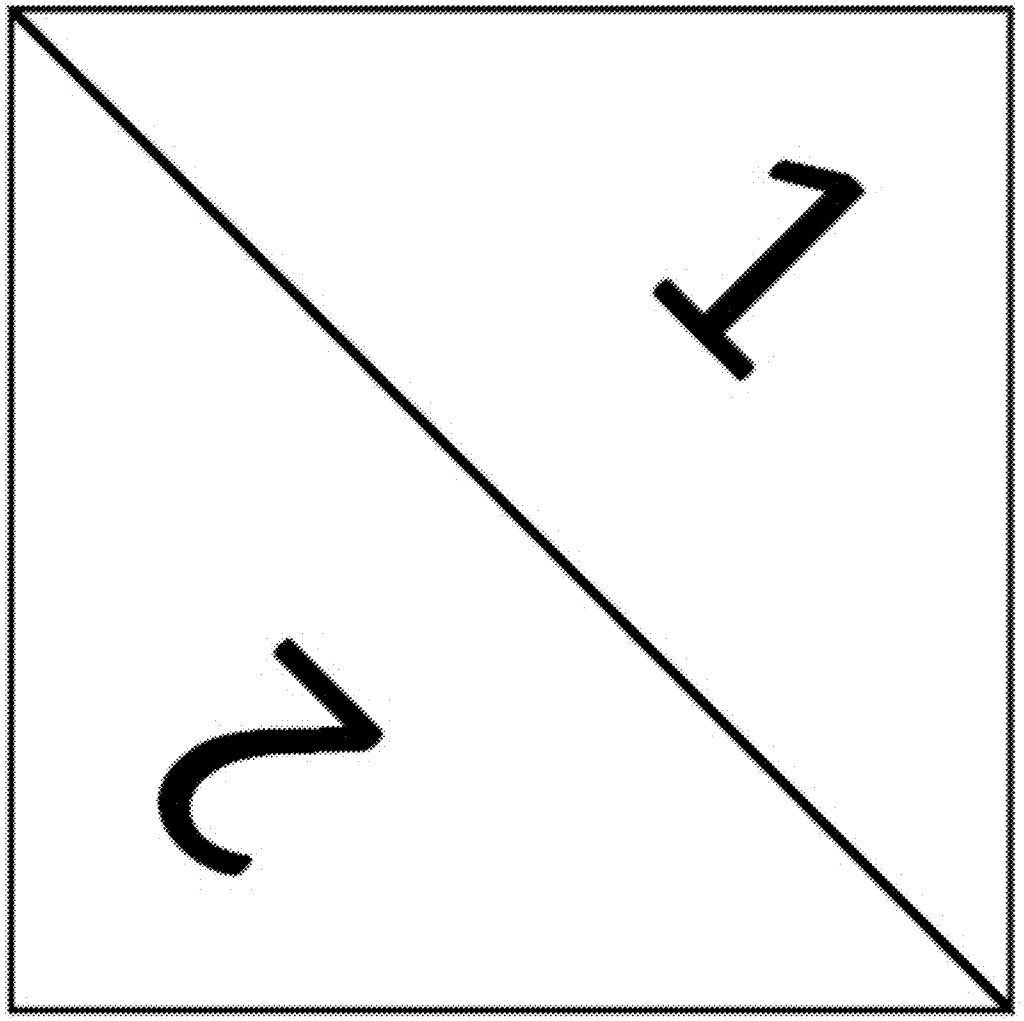
FIG. 8 is yet another design for a demarker that utilizes the demarking aspect of the various embodiments.

FIG. 8 is yet another design for a demarker that utilizes the demarking aspect of the various embodiments.

It should be appreciated that some readers may prefer to have an edge of the demarker to hang outside of the pages of the book to more readily find the reader's stopping point. To accommodate such readers, the length of the demarker may be selected so that a portion of the demarker is visible from the top, bottom or side edges of the book. Further, some embodiments may include a ribbon or string that is attached to the demarker. In such embodiments, the length of the ribbon or string can be selected to ensure that a portion (i.e., a tassel) will hang out from between the pages of the book.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A system for demarking a last-read line on a last-read page in bound material, comprising:

a single-piece flat object having a shape that includes at least two extremities;

a first indicia being positioned on a first side of the single-piece flat object at one of the at least two extremities;

a second indicia visibly different from the first indicia being positioned on the first side of the single-piece flat object at one of the at least two extremities such that the second indicia is located at an opposite extremity from the first indicia;

wherein the single-piece flat object is configured to be positioned in a gutter of a book such that only the first indicia or the second indicia is required to identify the last-read line on the last-read page and the last read column, and wherein a second side of the single-piece flat object does not include any indicia utilized to functionally identify the last-read line on the last-read page.

2. The system of claim 1, wherein the single-piece flat object includes at least 4 extremities.

3. The system of claim 2, wherein the single-piece flat object is substantially square.

4. The system of claim 3, wherein the shape of the single-piece flat object includes a plurality of edges and each edge of the single-piece flat object is 2.5 inches to 4.5 inches in length.

5. The system of claim 4, wherein each edge of the single-piece flat object is 3.25 inches.

6. The system of claim 2, wherein the single-piece flat object is substantially rectangular.

7. The system of claim 2, wherein the single-piece flat object is elongated having a first end and a second end and the first and second ends being tapered to a point.

8. The system of claim 1, wherein a thickness of the single-piece flat object is 14 to 24 points.

9. The system of claim 1, wherein a thickness of the single-piece flat object is 16 points.

10. A method for demarking a last-read line on a last-read page in bound material, the method comprising:

obtaining a flat object having a shape that includes at least two extremities;

placing a first indicia on one of the at least two extremities on a first side of the flat object; and placing a second indicia that is visibly different from the first indicia on one of the at least two extremities such that the second indicia is located at an opposite extremity from the first indicia and on the first side of the flat object;

inserting the flat object between a left-side page and a right-side page of the bound material such that:

if the bound material includes only one column of text and the last-read line is on the left-side page, orienting the flat object such that it is positioned with the first side up and on the right-side page with the first indicia proximate to a gutter of the bound material and proximate to the last-read line;

if the bound material includes only one column of text and the last-read line is on the right-side page, orienting the flat object such that it is positioned with the first side up and on the left-side page with the first indicia proximate to the gutter of the bound material and proximate to the last-read line;

if the bound material includes two columns of text and the last-read line is in a first column on the left-side page, orienting the flat object such that it is positioned with the first side up and on the right-side page with the first indicia proximate to the gutter of the bound material and proximate to the last-read line;

if the bound material includes two columns of text and the last-read line is in a first column on the right-side page, orienting the flat object such that it is positioned with the first side up and on the left-side page with the first indicia proximate to the gutter of the bound material and proximate to the last-read line.

11. A method for demarking a last-read line on a last-read page in bound material, the method comprising:

obtaining a flat object having a shape that includes at least two extremities;

placing a first indicia on one of the at least two extremities on a first side of the flat object; and placing a second indicia that is visibly different from the first indicia on one of the at least two extremities such that the second indicia is located at an opposite extremity from the first indicia and on the first side of the flat object;

inserting the flat object between a left-side page and a right-side page of the bound material such that:

if the bound material includes only one column of text and the last-read line is on the left-side page, orienting the flat object such that it is positioned with the first side up and on the right-side page with the first indicia proximate to a gutter of the bound material and proximate to the last-read line;

if the bound material includes only one column of text and the last-read line is on the right-side page, orienting the flat object such that it is positioned with the first side up and on the left-side page with the first indicia proximate to a gutter of the bound material and proximate to the last-read line;

if the bound material includes two columns of text and the last-read line is in a second column on the left-side page, orienting the flat object such that it is positioned with the first side up and on the right-side page with the second indicia proximate to a gutter of the bound material and proximate to the last-read line;

if the bound material includes two columns of text and the last-read line is in a second column on the right-side page, orienting the flat object such that it is positioned with the first side up and on the left-side page with the second indicia proximate to a gutter of the bound material and proximate to the last-read line.

12. A method for demarking a last-read line on a last-read page in a bound material, the method comprising:

obtaining a flat object having a shape that includes at least two extremities;

placing a first indicia on one of the at least two extremities on a first side of the flat object; and placing a second indicia that is visibly different from the first indicia on one of the at least two extremities such that the second indicia is located on an opposite extremity from the first indicia and on the first side of the flat object;

inserting the flat object between a left-side page and a right-side page of the bound material such that:

if the bound material includes only one column of text and the last-read line is on an upper area of the left-side page, orienting the flat object such that it is positioned with the first side up and on the right-side page with the first indicia proximate to a gutter of the bound material, proximate to the last-read line and rotated such that the first indicia is in an upper left corner;

if the bound material includes only one column of text and the last-read line is on a lower area of the left-side page, orienting the flat object such that it is positioned with the first side up and on the right-side page with the first indicia proximate to the gutter of the bound material, proximate to the last-read line and rotated such that the first indicia is in a lower left corner;

if the bound material includes only one column of text and the last-read line is on an upper area of the right-side page, orienting the flat object such that it is positioned with the first side up and on the left-side page with the first indicia proximate to the gutter of the bound material, proximate to the last-read line and rotated such that the first indicia is in an upper right corner; and if the bound material includes only one column of text and the last-read line is a lower area of the right-side page, orienting the flat object such that it is positioned with the first side up and on the left-side page with the first indicia proximate to the gutter of the bound material, proximate to the last-read line and rotated such that the first indicia is in a lower right corner;

if the bound material includes two columns of text and the last-read line is in an upper area of a first column on the left-side page, orienting the flat object such that it is positioned with the first side up and on the right-side page with the first indicia proximate to the gutter of the bound material, proximate to the last-read line and rotated such that the first indicia is in the upper left corner;

if the bound material includes two columns of text and the last-read line is in a lower area of the first column on the left-side page, orienting the flat object such that it is positioned with the first side up and on the right-side page with the first indicia proximate to the gutter of the bound material, proximate to the last-read line and rotated such that the first indicia is in the lower left corner;

if the bound material includes two columns of text and the last-read line is in an upper area of a first column on the right-side page, orienting the flat object such that it is positioned with the first side up and on the left-side page with the first indicia proximate to the gutter of the bound material, proximate to the last-read line and rotated such that the first indicia is in the upper right corner; and if the bound material includes two columns of text and the last-read line is in a lower area of the first column on the right-side page, orienting the flat object such that it is positioned with the first side up and on the left-side page with the first indicia proximate to the gutter of the bound material, proximate to the last-read line and rotated such that the first indicia is in the lower right corner.

13. The method of claim 12, further comprises inserting the flat object between a left-side page and a right-side page of the bound material such that:

if the bound material includes two columns of text and the last-read line is in an upper are of a second column on the left-side page, orienting the flat object such that it is positioned with the first side up and on the right-side page with the second indicia proximate to the gutter of the bound material, proximate to the last-read line and rotated such that the second indicia is in the upper left corner;

if the bound material includes two columns of text and the last-read line is in a lower half of the second column on the left-side page, orienting the flat object such that it is positioned with the first side up and on the right-side page with the second indicia proximate to the gutter of the bound material, proximate to the last-read line and rotated such that the second indicia is in the lower left corner;

if the bound material includes two columns of text and the last read-line is in an upper half of a second column on the right-side page, orienting the flat object such that it is positioned with the first side up and on the left-side page with the second indicia proximate to the gutter of the bound material, proximate to the last-read line and rotated such that the second indicia is in the upper right corner; and if the bound material includes two columns of text and the last-read line is in a lower half of the second column on the right-side page, orienting the flat object such that it is positioned with the first side up and on the left-side page with the second indicia proximate to the gutter of the bound material, proximate to the last-read line and rotated such that the second indicia is in the lower right corner.

14. The method of claim 13, wherein the flat objection is substantially square-shaped and the two extremities are diagonally opposite corners, further comprising:

placing the first indicia on one of the at least two extremities by placing the first indicia in the upper left corner of the flat object;

placing the second indicia on one of the at least two extremities by placing the second indicia in the lower right corner; and ensuring that the first indicia and the second indicia are not included on a second side of the flat object.

15. The method of claim 14, wherein obtaining a flat object further comprises obtaining a flat object wherein each side of the flat object is 2.5 inches to 4.5 inches.

16. The method of claim 15, wherein obtaining a flat object further comprises obtaining a flat object wherein a thickness of the flat object is 14 to 24 points.

17. The method of claim 15, wherein obtaining a flat object further comprises obtaining a flat object wherein a thickness of the flat object is 16 points.

* * * * *